United States Patent [19]

Matsuura et al.

[11] Patent Number: 4,683,856

[45] Date of Patent: Aug. 4, 1987

[54] ENGINE ROUGHNESS CONTROL MEANS

[75] Inventors: Masahiko Matsuura; Nobuo Doi, both of Hiroshima; Sadashichi Yoshioka, Higashihiroshima; Haruo Okimoto, Hiroshima; Kazuhiko Ueda, Higashihiroshima, all of Japan

[73] Assignee: Mazda Motor Corporation, Hiroshima, Japan

[21] Appl. No.: 768,229

[22] Filed: Aug. 22, 1985

[30] Foreign Application Priority Data

Aug. 28, 1984 [JP] Japan ..... 59-178697

[51] Int. Cl.[4] ..... F02D 41/04; F02P 5/15

[52] U.S. Cl. ..... 123/436; 123/419

[58] Field of Search ..... 123/419, 436

[56] References Cited

U.S. PATENT DOCUMENTS 4,178,891 12/1979 Latsch et al. ..... 123/419

4,509,484 4/1985 Gertiser ..... 123/436

FOREIGN PATENT DOCUMENTS 114141 7/1982 Japan .

162752 9/1983 Japan ..... 123/436

*Primary Examiner*—Tony M. Argenbright

*Attorney, Agent, or Firm*—Fleit, Jacobson, Cohn & Price

[57] ABSTRACT

A control system for a vehicle engine in which fuel supply quantity is controlled in accordance with the engine roughness level. An engine roughness sensor is provided for detecting engine vibrations and producing a roughness signal which is compared with a reference signal. When the roughness signal is greater than the reference signal, the fuel supply is increased to enrich the air-fuel mixture but, when the roughness signal is smaller than the reference signal, the fuel supply is decreased to make the mixture leaner. The reference signal is smallest in idling operation and stepwisely increased depending on an increase in the load on the engine.

9 Claims, 5 Drawing Figures

ENGINE ROUGHNESS CONTROL MEANS

BACKGROUND OF THE INVENTION

1. Field of the Invention

The present invention relates to a control for an internal combustion engine and more particularly an engine control based on engine roughness.

2. Description of the Prior Art

In modern automobile engines, the fuel supply to the engine is controlled so that the air-fuel mixture be made as lean as possible to thereby improve fuel economy. It should however be noted that, if the mixture is excessively lean, there will be produced an uncomfortable engine roughness caused by torque fluctuations due to misfire. It is therefore desirable in the field of engines to improve that fuel economy while suppressing the torque fluctuations.

In Japanese utility model application No. 56-257 filed on Jan. 7, 1981, and disclosed for public inspection on July 15, 1982, under the disclosure number 57-114141, there is disclosed an engine control system including a torque fluctuation detecting device for detecting engine torque fluctuations, and a comparing device for comparing the torque fluctuation signals from the torque fluctuation detecting device with a reference value so that the fuel supply to the engine is decreased when the torque fluction signals are below the reference signal, but the fuel supply is increased when the torque fluctuation signals are greater than the reference signal to thereby decrease the torque fluctuations. With this control, it is possible to suppress the engine torque fluctuations to a minimum level with the fuel supply maintained as low as possible.

It should, however, be pointed out that the engine torque fluctuation, that is, the engine roughness level, changes depending on the engine operating conditions, such as the load on the engine and the engine temperature. For example, the roughness level is higher under loaded engine operation than under an idling operation. Further, the roughness level increases as the engine load increases. Despite these facts, if the reference signal is fixed to a value which is appropriate for obtaining a desired result under an idling operation, there will be a tendency that the fuel supply is increased under loaded operation due to an increase in the roughness level.

SUMMARY OF THE INVENTION

It is therefore an object of the present invention to provide an engine control system in which fuel economy can be improved in an automobile engine without giving any adverse effect on riding comfort.

Another object of the present invention is to provide an engine control system in which control is performed based on the engine roughness level in such a manner that the fuel supply can be decreased even under loaded engine operation without disturbing riding comfort.

A further object of the present invention is to provide an engine control system in which control is made on the basis of the engine roughness level, of which the value is changed in accordance with the operating conditions of the vehicle on which the engine is mounted.

The present invention is based on the inventors' recognition that the passenger's sensitivity to engine vibration changes depending on the vehicle operating condition. For example, the passenger becomes less sensitive to engine vibrations when the vehicle is running than when the vehicle is stationary. Thus, according to the present invention, the reference value under which engine roughness control is carried out is changed in accordance with the vehicle operating condition, such as the engine load. For example, the reference value is increased in response to an increase in the engine load, so that the air-fuel mixture is made leaner than in a conventional engine under loaded engine operation without giving any adverse effects on riding comfort.

According to the present invention, there is therefore provided a control system for a vehicle engine comprising engine condition detecting means for detecting an engine operating condition and producing an engine condition signal representing the engine operating condition, engine combustion control means for controlling a condition of combustion in the engine, memory means for memorizing control factors for controlling the engine combustion control means under various engine operating conditions, said memory means being connected with said engine condition detecting means for receiving the engine condition signal therefrom to thereby output one of the control factors for controlling the engine combustion control means which corresponds to the engine operating condition detected by the engine condition detecting means, engine roughness detecting means for detecting engine vibrations caused by unstable engine combustion and for producing a roughness signal representing a level of the engine vibrations, reference means for providing a reference signal, comparator means for comparing the roughness signal with the reference signal, modifying means connected with said comparator means to receive an output therefrom and modifying the control factor from the memory means by the output of the comparator means so that the combustion control means is controlled by the modified control factor, and reference changing means connected with said engine condition detecting means to change the reference signal in accordance with the engine operating condition. The engine combustion control means may be fuel supply control means for controlling fuel supply to establish a specific air-fuel ratio. Alternatively, the engine combustion control means may be ignition timing control means for controlling the ignition timing. The modifying means may increase the fuel supply or retard the ignition timing when the roughness signal is higher than the reference signal, and decrease the fuel supply or advance the ignition timing when the roughness signal is lower than the reference value.

The above and other objects and features of the present invention will become apparent from the following description of preferred embodiments, taking reference to the accompanying drawings.

DESCRIPTION OF THE PREFERRED EMBODIMENTS

Figure 1:
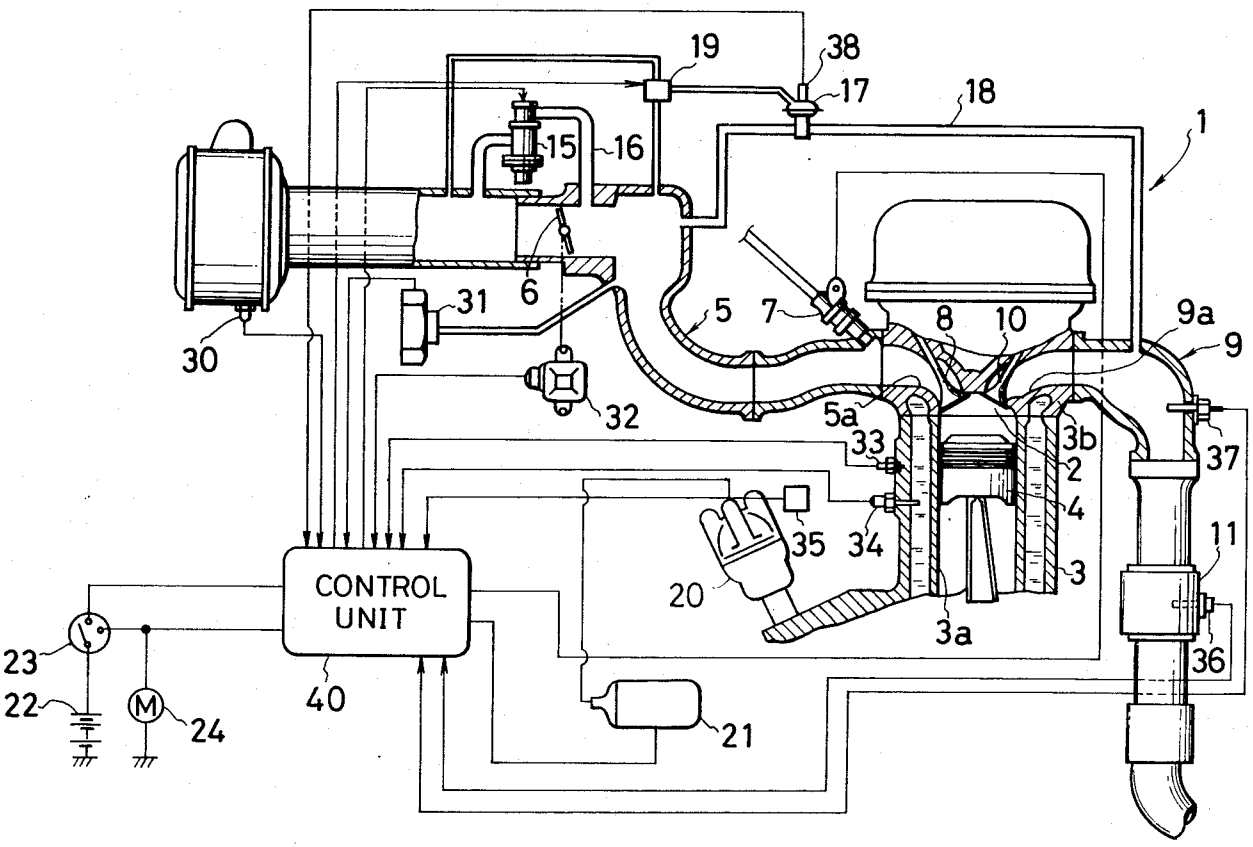
FIG. 1 is a sectional view of an engine having a control system in accordance with the present invention.

Referring to the drawings, particularly to FIG. 1, there is shown an engine 1 including a cylinder block 3 formed with a cylinder bore 3*a*, and a cylinder head 3*b* attached to the cylinder block 3. In the cylinder bore 3*a*, there is disposed a piston 4 which is adapted for reciprocating movements therein. The cylinder block 3, the cylinder head 3*b* and the piston 4 together define a combustion chamber 2. The cylinder head 3*b* is formed with an intake port 5*a* and an exhaust port 9*a*, which are connected respectively with an intake passage 5 and an exhaust passage 9. The intake port 5*a* and the exhaust port 9*a* are respectively provided with an intake valve 8 and an exhaust valve 10.

In the intake passage 5, there is provided a throttle valve 6. A fuel injection valve 7 is provided in the intake passage 5 in the vicinity of the intake port 5*a*. The exhaust passage 9 is provided with a catalytic device 11. A bypass passage 16 is provided in the intake passage 5 across the throttle valve 6, and a bypass control valve 15 is in the bypass passage 16. Between the intake passage 5 and the exhaust passage 9, there extends an exhaust gas recirculation passage 18 which has an exhaust gas recirculation control valve 17. The exhaust gas recirculation control valve 17 is of a type that is actuated under a suction pressure. For controlling the supply of the suction pressure to the valve 17, there is provided a solenoid valve 19. Although not shown in FIG. 1, the engine 1 has an ignition plug which is mounted on the cylinder head, and a distributor 20 and an ignition coil 21 are provided for energizing the ignition plug.

In order to control the fuel supply to the fuel injection valve 7 and the ignition timing, the engine 1 is provided with a control unit 40. As the electrical power source, there is provided a battery 22 which is connected through a main switch 23 with the control unit 40. The main switch 23 further controls a power supply to a starter motor 24.

The engine 1 has an airflow sensor 30 provided in the intake passage 5 for detecting the intake airflow. In the intake passage 5 there is further provided an intake pressure sensor 31, which detects the intake pressure downstream of the throttle valve 6. The position of the throttle valve 6 is detected by a throttle position sensor 32. In order to detect the engine roughness in terms of the engine vibrations caused by unstable combustion, the cylinder block 3 is provided with a roughness sensor 33. The engine 1 is also provided with a cooling water temperature sensor 34 for detecting the engine cooling water temperature, and an engine speed sensor 35 for detecting the engine speed. On the catalytic device 11, there is a catalyst temperature sensor 36 for detecting the temperature of the catalyst in the device 11. In the exhaust passage 9, there is provided an $O_2$ sensor 37. Further, the exhaust gas recirculation control valve 17 is provided with a valve position sensor 38. The output signals from the sensors 30 to 38 are applied to the control unit 40.

Figure 2:
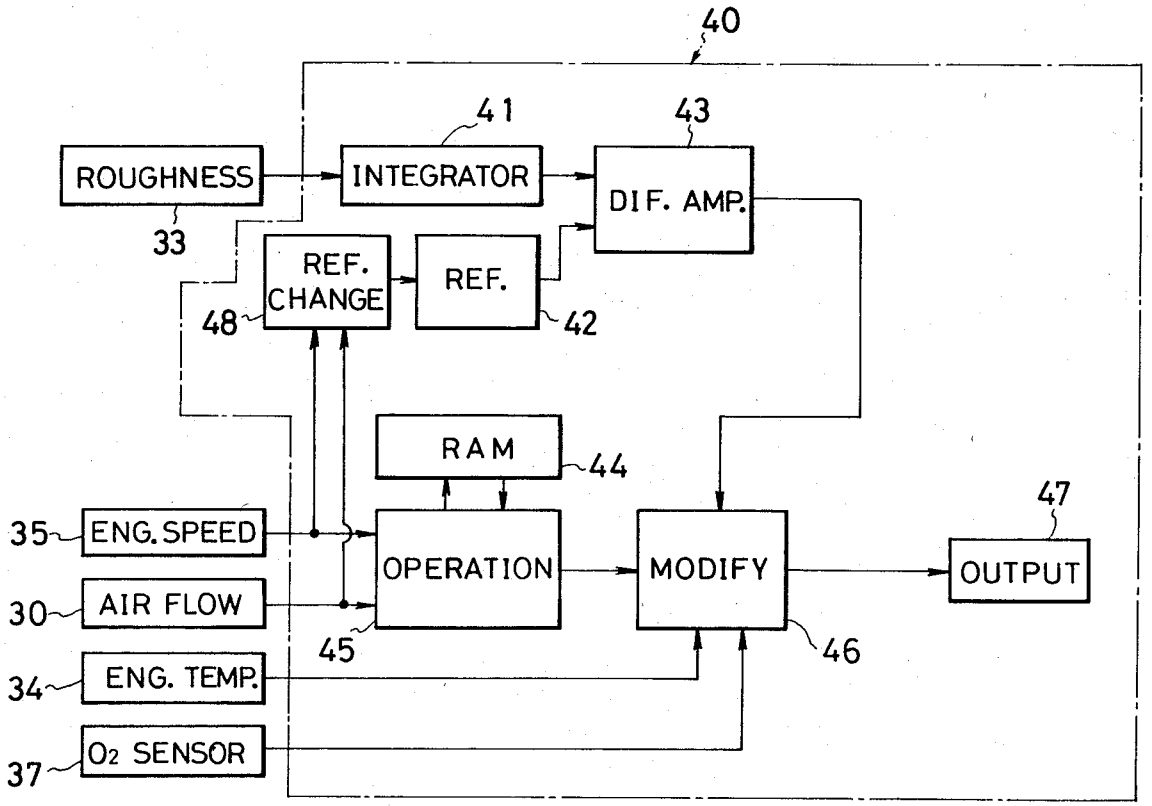
FIG. 2 is a block diagram of a control system in accordance with one embodiment of the present invention.

As shown in FIG. 2, the control unit 40 includes an integrator 41 which is connected with the roughness sensor 33. The integrator 41 functions to integrate the vibration signals from the sensor 33 and perform an analogue-digital conversion to produce a digital output. The output of the integrator 41 is connected with a differential amplifier 43. A reference circuit 42 is provided for applying a reference signal to the differential amplifier 43 so that the engine vibration signal from the integrator 41 is compared with the reference signal. The control unit 40 further includes a RAM 44 which memorizes basic fuel supply quantities for various engine operating conditions which are determined by the engine speed and the intake airflow. An operation circuit 45 is connected with the RAM 44 for reading an appropriate one of the basic fuel supply quantities memorized in the RAM 44 in accordance with the engine operating condition. For that purpose, the operation circuit 45 is connected with the engine speed sensor 35 and the airflow sensor 30. The output of the operation circuit 45 is applied to a modifying circuit 46 which is also connected with the output of the differential amplifier 43. The modifying circuit 46 is further connected with the cooling water temperature sensor 34 and the $O_2$ sensor 37. The modifying circuit 46 functions to modify the basic fuel quantity signal from the operation circuit 45 in accordance with the signal from the differential amplifier 43 and the signals from the sensors 34 and 37. The output of the modifying circuit 46 is applied to an output circuit 47 which produces an output for energizing the fuel injection valve 7 to provide a required supply of fuel to the engine 1.

It will be noted in FIG. 2 that the control unit 40 is further provided with a reference changing circuit 48 which has inputs connected with the airflow sensor 30 and the engine speed sensor 35. The output of the reference changing circuit 48 is connected with the reference circuit 42. The circuit 48 functions to change the reference signal from the reference circuit 42 in accordance with the engine operating condition as judged from the output signals of the sensors 30 and 35.

Figure 3:
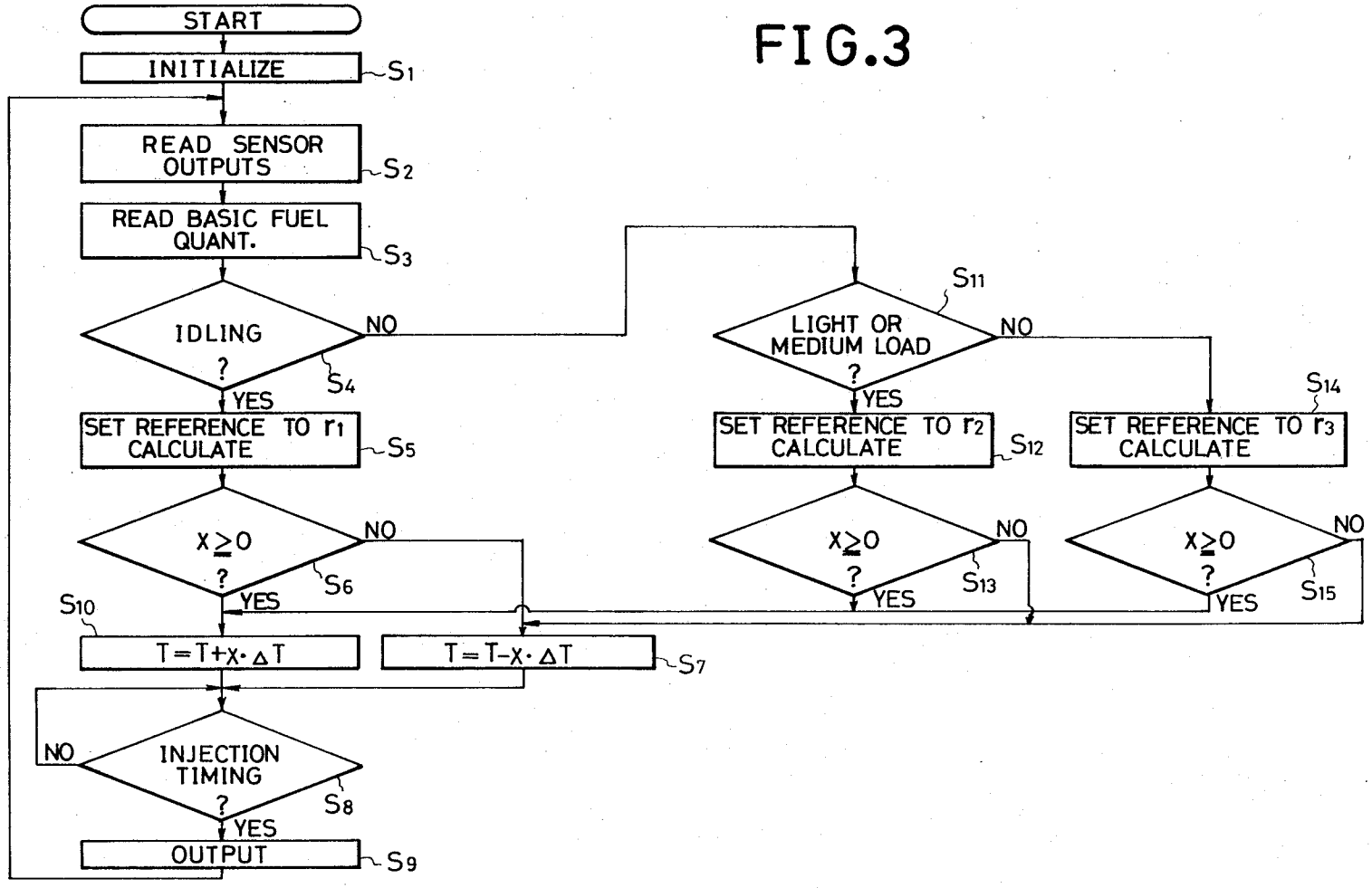
FIG. 3 is a program flow chart showing the operation of the control unit.
Figure 5:
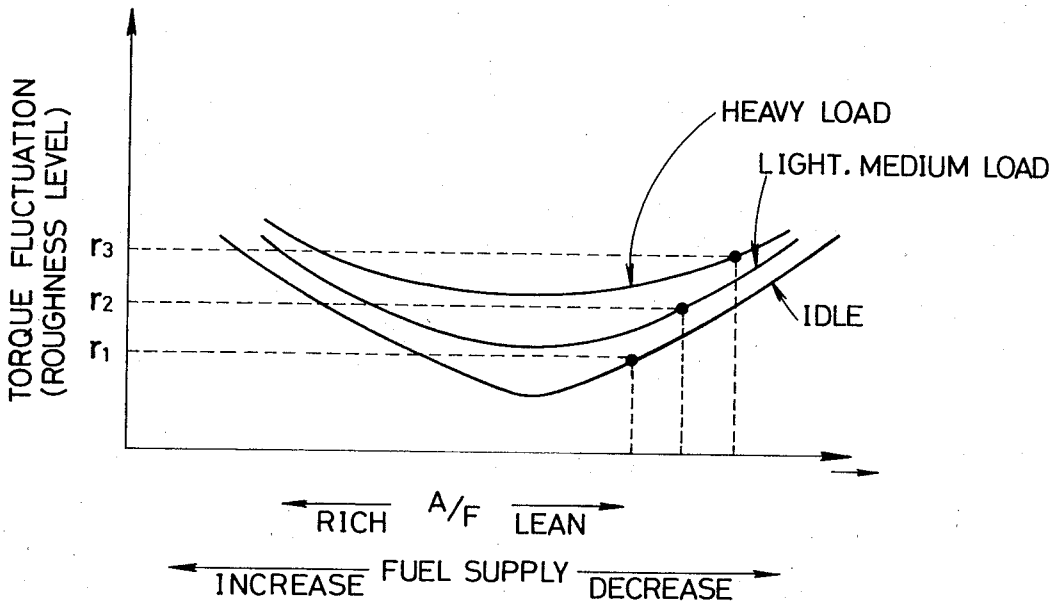

Referring to FIG. 3, in operation of the control unit 40, the unit 40 is at first initialized in step $S_1$ and the signals from the roughness sensor 33, the airflow sensor 30 and the engine speed sensor 35 are read in step $S_2$. Then, the basic fuel quantity is read by the operation circuit 45 from the RAM 44 in step $S_3$ based on the airflow signal and the engine speed signal from the sensors 30 and 35, respectively. Thereafter, a judgement is made in step $S_4$ by the reference changing circuit 48 as to whether the engine is idling or not. When the result of the judgement is YES, a step $S_5$ is carried out wherein the reference changing circuit 48 applies a signal to the reference circuit 42 so that the reference circuit 42 produces a reference signal $r_1$ which is of the smallest value as shown in FIG. 5, and the differential amplifier 43 produces a signal corresponding to a difference $\chi$ between the engine vibration signal R and the reference signal $r_1$. Then, a judgement is further made in step $S_6$ by the modifying circuit 46 as to whether the difference is not smaller than O. If the result of the judgement is NO, the modifying circuit 46 modifies the basic fuel quantity signal from the operation circuit 45 in step $S_7$ by the formula $T' = Tp31\ \chi \cdot \Delta T$ to decrease the fuel supply below the basic quantity. In this formula, $\Delta T$ is a constant. Thereafter, the fuel injection timing is judged in step $S_8$ and an output for fuel injection is produced in step $S_9$.

When the result of the judgement in step $S_6$ is YES, it is judged that the engine vibration is too strong and the fuel supply is increased. For that purpose, the modifying circuit 46 modifies the basic fuel quantity signal T in step $S_{10}$ by the formula $T' = T + \chi \cdot \Delta T$. After the step $S_9$, the procedure is returned to step $S_2$.

When the result of the judgement in step $S_4$ is NO, it is judged that the vehicle is running and a further judgement is made in step $S_{11}$ by the reference changing circuit 48, based on the signals from the sensors 30 and 35, as to whether the engine is under a light or medium load. If the result of the judgement is YES, the control unit 40 carries out a step $S_{12}$ wherein the reference changing circuit 48 applies a signal to the reference circuit 42 so that the reference circuit 42 produces a reference signal which is of a value $r_2$ greater than the value $r_1$ as shown in FIG. 5, and the differential amplifier 43 compares the engine vibration signal R with the reference signal $r_2$. Then, a judgement is made in step $S_{13}$ by the modifying circuit 46 as to whether the difference $\chi$ between the engine vibration signal R and the reference signal $r_2$ is not smaller than O. If the result of the judgement is NO, the step $S_7$ is carried out but, if the result of the judgement is YES, the step $S_{10}$ is carried out.

When the judgement in step $S_{11}$ is NO, it is judged that the engine 1 is under a heavy load operation and the process proceeds to step $S_{14}$, wherein the reference changing circuit 48 applies a signal to the reference circuit 42 so that the reference circuit 42 produces a reference signal which is of a value $r_3$ greater than the value $r_2$ as shown in FIG. 5, and the differential amplifier 43 compares the engine vibration signal R with the reference signal $r_3$. Thereafter, a judgement is made in step $S_{15}$ as to whether the difference $\chi$ between the engine vibration signal R and the reference signal $r_3$ is not smaller than O. If the result of the judgement is NO, the step $S_7$ is carried out. However, if the result of the judgement is YES, the step $S_{10}$ is carried out.

According to the control system described above, when the engine is in idling operation, the minimum value $r_1$, selected for the reference value. Therefore, the engine vibration can be suppressed to a satisfactory level. Under loaded operation of the engine, the reference value is increased so that the engine is operated with a leaner air-fuel mixture. The engine vibration level may be raised but this does not cause any problem because the passengers's sensitivity to engine vibrations decreases under loaded engine operation. The engine control described above can therefore improve fuel economy without producing any other problems.

Figure 4:
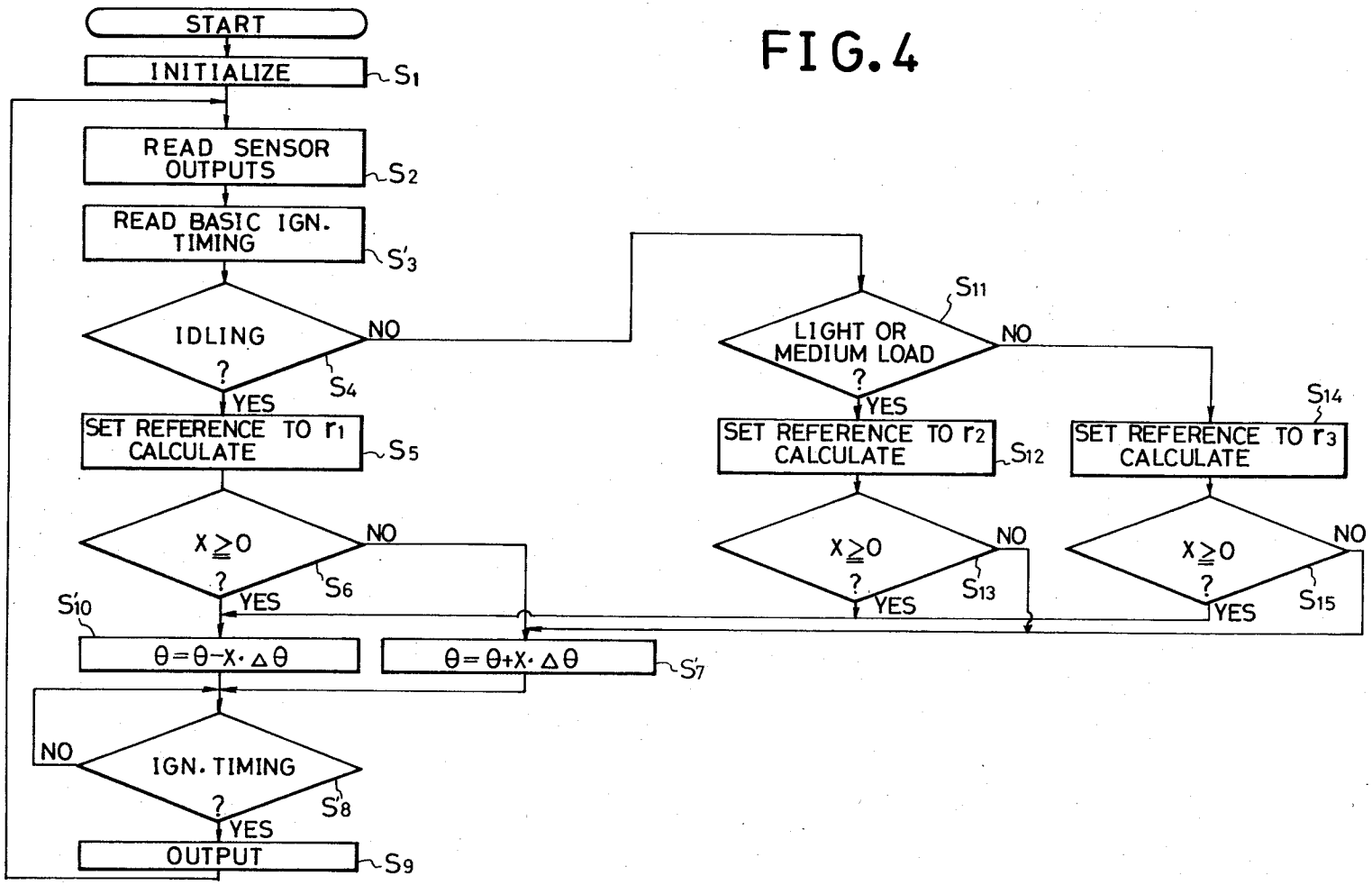
FIG. 4 is a program flow chart in accordance with another embodiment of the present invention; and, FIG. 5 is a diagram showing the reference signals for different engine operating conditions.

Referring to FIG. 4, there is shown another example of the engine control, in which the engine ignition timing is controlled instead of the fuel supply in the previous embodiment, In this embodiment, the RAM 44 has a memory of ignition timings for various engine operating conditions. In the step $S'_3$, the operation circuit 45 therefore reads a basic ignition timing $\theta$ for the actual engine operating condition. In steps $S'_7$ and $S'_{10}$, the basic ignition timing is modified by the formulae $\theta=\theta+\chi\cdot\Delta\theta$ and $\theta=\theta-\chi\cdot\Delta\theta$, respectively. Where the engine vibration level is smaller than the reference value, the ignition timing is advanced. However, when the engine vibration level is higher than the reference value, the ignition timing is retarded. In step $S'_8$, a judgement is made as to whether the ignition timing is changed or not. In other respects, the control steps are the same as those in the previous embodiment.

The invention has thus been shown and described with reference to specific embodiments. However, it should be noted that the invention is in no way limited to the details of these embodiments, but changes and modifications may be made without departing from the scope of the appended claims. For example, the fuel supply and the ignition timing may simultaneously be controlled. Further, the reference value may be changed in accordance with the engine temperature. For example, the reference value may be increased under a cold engine condition because the engine vibration level is generally high under a cold engine condition.

We claim:

1. A control system for a vehicle engine comprising engine condition detecting means for detecting an engine operating condition and producing an engine condition signal representing the engine operating condition, engine combustion control means for controlling a condition of combustion in the engine, control factor storage means for storing control factors for controlling the engine combustion control means under various engine operating conditions, said storage means being connected with said engine condition detecting means for receiving the engine condition signal therefrom to thereby output one of the control factors for controlling the engine combustion control means which corresponds to the engine operating condition detected by the engine condition detecting means, engine roughness detecting means for detecting engine vibrations caused by unstable engine combustion and producing a roughness signal representing a level of the engine vibrations, reference means for providing a reference roughness signal, comparator means for comparing the roughness signal with the reference roughness signal to provide an output signal when the roughness signal exceeds the reference roughness signal, modifying means connected with said comparator means to receive said output signal thereform and to modify the control factor from the storage means by the output of the comparator means so that the combustion control means is controlled by the modified control factor in a direction that the engine vibrations are suppressed, reference signal changing means connected with said engine condition detecting means to change the reference roughness signal in accordance with the engine operating condition so that the reference signal is decreased when the engine is in idling operation.

2. A control system in accordance with claim 1 in which said engine combustion control means is fuel supply control means, said storage means having memories of values for determining fuel supply quantities for various engine operating condition.

3. A control system in accordance with claim 1 in which said engine combustion control means is ignition timing control means, said storage means having memories of ignition timings for various engine operating conditions.

4. A control system in accordance with claim 1 in which said reference changing means is means for increasing the reference value in response to an increase in egnine load.

5. A control system in accordance with claim 2 in which said modifying means is means for increasing the fuel supply when the roughness signal in greater than the reference signal and decreasing the fuel supply when the roughness signal is smaller than the reference signal.

6. A control system in accordance with claim 3 in which said modifying means is means for retarding the ignition timing when the roughness signal is greater than the reference signal and advancing the ignition timing when the roughness signal is smaller than the reference signal.

7. A control system for a vehicle engine comprising engine condition detecting means for detecting an engine operating condition and producing an engine condition signal representing the engine operating condition, engine combustion control means for controlling a condition of combustion in the engine, control factor storage means for storing control factors for controlling the engine combustion control means under various engine operating conditions, said storage means being connected with said engine condition detecting means for receiving the engine condition signal therefrom to thereby output one of the control factors for controlling the engine combustion control means which corresponds to the engine operating condition detected by the engine condition detecting means, engine roughness detecting means for detecting engine vibrations caused by unstable engine combustion and producing a roughness signal representing a level of the engine vibrations, reference means for providing a first reference roughness signal and a second reference roughness signal which is greater than said first reference roughness signal, reference signal changing means responsive to the engine condition signal for making the reference means output said first reference roughness signal when the engine is in an idling operation condition and said second reference roughness signal when the engine is not in the idling operation condition, comparator means for comparing the roughness signal with the reference roughness signal from the reference means to provide an output signal when the roughness signal is greater than the reference roughness signal, modifying means connected with said comparator means to receive said output signal therefrom and modifying the control factor from the storage means by the output of the comparator means so that the combustion control means is controlled by the modified control factor.

8. A control system in accordance with claim 7 in which said reference changing means is responsive to engine load so that the first reference signal is produced under an idling operation and the second reference is produced under a loaded operation of the engine as the output of the reference means.

9. A control system for a vehicle engine comprising engine condition detecting means for detecting an engine operating condition and producing an engine condition signal representing the engine operating condition, engine combustion control means for controlling a condition of combustion in the engine, means for providing a control factor for controlling the engine combustion control means in accordance with engine operating conditions, said control factor providing means being connected with said engine condition detecting means for receiving the engine condition signal thereform to thereby output the control factor for controlling the engine combustion control means in accordance with the engine operating condition detected by the engine condition detecting means, engine roughness detecting means for detecting engine vibrations caused by unstable engine combustion and producing a roughness signal representing a level of the engine vibrations, reference means for providing a reference roughness signal, comparator means for comparing the roughness signal with the reference roughness signal, modifying means connected with said comparator means to receive an output therefrom and to modify the control factor from the control factor providing means by the output of the comparator means so that the combustion control means is controlled by the modified control factor, reference signal changing means connected with said engine condition detecting means to change the reference roughness signal in accordance with the engine operating condition so that the reference roughness signal is decreased when the engine is in idling operation.

* * * * *